US006850251B1

(12) United States Patent
Yasunishi et al.

(10) Patent No.: US 6,850,251 B1
(45) Date of Patent: Feb. 1, 2005

(54) CONTROL CIRCUIT AND CONTROL METHOD FOR DISPLAY DEVICE

(75) Inventors: Norio Yasunishi, Kitakatsuragi-gun (JP); Futoshi Satoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/489,383

(22) Filed: Jan. 21, 2000

(30) Foreign Application Priority Data

Jan. 21, 1999 (JP) ..... 11-013645

(51) Int. Cl.[7] ..... G09G 5/02
(52) U.S. Cl. ..... 345/693; 345/691; 345/696
(58) Field of Search ..... 345/690, 691, 345/692, 693, 696, 89, 99, 204

(56) References Cited

U.S. PATENT DOCUMENTS 5,448,314 A * 9/1995 Heimbuch et al. ..... 348/270
5,798,743 A * 8/1998 Bloom ..... 345/692
6,034,659 A * 3/2000 Wald et al. ..... 315/169.3
6,175,355 B1 * 1/2001 Reddy ..... 345/691
6,215,469 B1 * 4/2001 Mori et al. ..... 345/60

FOREIGN PATENT DOCUMENTS

JP 2-1812 1/1990
JP 10-161610 6/1998

* cited by examiner

*Primary Examiner*—Kent Chang
(74) *Attorney, Agent, or Firm*—David G. Conlin; William J. Daley, Jr.; Edwards & Angell, LLP

(57) ABSTRACT

A control circuit for use in a display device capable of displaying gray scale including a plurality of column electrodes and a plurality of row electrodes intersecting each other and pixels provided around the intersections thereof, includes a display data converting section for receiving input display data, dividing the input display data into binary display data and gray scale display data in such a manner as to enable pulse width modulation one frame in a plurality of frames, and outputting the binary display data and the gray scale display data: a pulse controlling section for determining the timing of applying a voltage to each of the plurality of column electrodes for the gray scale display data; and a column electrode driving section for applying a voltage corresponding to the gray scale display data to at least one said column electrode based on the timing of applying a voltage determined by the pulse controlling section.

12 Claims, 11 Drawing Sheets

*FIG. 2*

●: OFF-display

First frame

| | | | |
|---|---|---|---|
| P11 5/15 gray level | P12 5/15 | P13 5/15 | P14 5/15 |
| P21 5/15 | P22 5/15 | P23 5/15 | P24 5/15 |
| P31 5/15 | P32 5/15 | P33 5/15 | P34 5/15 |
| P41 5/15 | P42 5/15 | P43 5/15 | P44 5/15 |

Second frame

| | | | |
|---|---|---|---|
| P11 ● | P12 ● | P13 ● | P14 ● |
| P21 ● | P22 ● | P23 ● | P24 ● |
| P31 ● | P32 ● | P33 ● | P34 ● |
| P41 ● | P42 ● | P43 ● | P44 ● |

Third frame

| | | | |
|---|---|---|---|
| P11 ● | P12 ● | P13 ● | P14 ● |
| P21 ● | P22 ● | P23 ● | P24 ● |
| P31 ● | P32 ● | P33 ● | P34 ● |
| P41 ● | P42 ● | P43 ● | P44 ● |

Fourth frame

| | | | |
|---|---|---|---|
| P11 ● | P12 ● | P13 ● | P14 ● |
| P21 ● | P22 ● | P23 ● | P24 ● |
| P31 ● | P32 ● | P33 ● | P34 ● |
| P41 ● | P42 ● | P43 ● | P44 ● |

*FIG. 4C*

●: OFF-display

First frame

| | | | |
|---|---|---|---|
| P11 5/15 gray level | P12 ● | P13 ● | P14 ● |
| P21 ● | P22 ● | P23 5/15 | P24 ● |
| P31 ● | P32 5/15 | P33 ● | P34 ● |
| P41 ● | P42 ● | P43 ● | P44 5/15 |

Second frame

| | | | |
|---|---|---|---|
| P11 ● | P12 5/15 | P13 ● | P14 ● |
| P21 ● | P22 ● | P23 ● | P24 5/15 |
| P31 5/15 | P32 ● | P33 ● | P34 ● |
| P41 ● | P42 ● | P43 5/15 | P44 ● |

Third frame

| | | | |
|---|---|---|---|
| P11 ● | P12 ● | P13 ● | P14 5/15 |
| P21 ● | P22 5/15 | P23 ● | P24 ● |
| P31 ● | P32 ● | P33 5/15 | P34 ● |
| P41 5/15 | P42 ● | P43 ● | P44 ● |

Fourth frame

| | | | |
|---|---|---|---|
| P11 ● | P12 ● | P13 5/15 | P14 ● |
| P21 5/15 | P22 ● | P23 ● | P24 ● |
| P31 ● | P32 ● | P33 ● | P34 5/15 |
| P41 ● | P42 5/15 | P43 ● | P44 ● |

*FIG. 7*

First frame

| | | | |
|---|---|---|---|
| P11<br>2/15<br>gray level | P12<br>1/15 | P13<br>1/15 | P14<br>1/15 |
| P21<br>1/15 | P22<br>1/15 | P23<br>2/15 | P24<br>1/15 |
| P31<br>1/15 | P32<br>2/15 | P33<br>1/15 | P34<br>1/15 |
| P41<br>1/15 | P42<br>1/15 | P43<br>1/15 | P44<br>2/15 |

Second frame

| | | | |
|---|---|---|---|
| P11<br>1/15 | P12<br>2/15 | P13<br>1/15 | P14<br>1/15 |
| P21<br>1/15 | P22<br>1/15 | P23<br>1/15 | P24<br>2/15 |
| P31<br>2/15 | P32<br>1/15 | P33<br>1/15 | P34<br>1/15 |
| P41<br>1/15 | P42<br>1/15 | P43<br>2/15 | P44<br>1/15 |

Third frame

| | | | |
|---|---|---|---|
| P11<br>1/15 | P12<br>1/15 | P13<br>1/15 | P14<br>2/15 |
| P21<br>1/15 | P22<br>2/15 | P23<br>1/15 | P24<br>1/15 |
| P31<br>1/15 | P32<br>1/15 | P33<br>2/15 | P34<br>1/15 |
| P41<br>2/15 | P42<br>1/15 | P43<br>1/15 | P44<br>1/15 |

Fourth frame

| | | | |
|---|---|---|---|
| P11<br>1/15 | P12<br>1/15 | P13<br>2/15 | P14<br>1/15 |
| P21<br>2/15 | P22<br>1/15 | P23<br>1/15 | P24<br>1/15 |
| P31<br>1/15 | P32<br>1/15 | P33<br>1/15 | P34<br>2/15 |
| P41<br>1/15 | P42<br>2/15 | P43<br>1/15 | P44<br>1/15 |

CONTROL CIRCUIT AND CONTROL METHOD FOR DISPLAY DEVICE

BACKGROUND OF THE INVENTION

1. Field of the Invention

The present invention relates to a control circuit and a control method for a matrix type display device capable of providing gray scale display.

2. Description of the Related Art

A matrix type display device is used in various office automation equipment such as personal computers and word processors, multimedia information terminals, audio-visual equipment, game machines, and the like. Recently, a matrix type display device which can provide gray scale display is often used.

To provide gray scale, a frame modulation system or a pulse width modulation system is widely used in a control circuit of a conventional display device.

In the frame modulation system, a constant ON or OFF display voltage which is to be applied to each pixel is selected in a frame-by-frame basis, depending on a gray level which the pixel is to display. The gray level of a pixel is determined by the temporal average of the number of frames at which the ON display voltage is applied to the pixel. In this manner, gray scale display having two or more levels can be performed.

In the pulse width modulation system, the width of a pulse applied to each pixel is modulated depending on a gray level which the pixel is to display. In this manner, gray scale display having two or more levels can be performed.

Japanese Laid-Open Publication No. 2-1812 discloses a method in which gray scale obtained by the pulse width modulation is further subjected to the frame modulation.

The frame modulation system, however, poses the following problem. To provide a given number of levels of gray scale, the necessary number of frames is at least (the number of levels-1). Therefore, the number of frames increases in proportion to the number of levels of gray scale. The increased number of frames leads to a significant flicker or waving in a display. For this reason, when the frame modulation system is used for a liquid crystal panel having high speed response, for example, the problem becomes more significant. To avoid the problem, the maximum number of frames is around four in practical use.

The pulse width modulation system needs to create a pulse corresponding to a given gray level within a period of one horizontal scanning time. Accordingly, the number of times that a data signal changes is more than when the gray scale display is not required. For this reason, the frequency of the data voltage signal becomes higher, resulting in the significant rounding of the data voltage signal caused by electrode resistance and liquid crystal capacity and the wave-form distortion of a scanning voltage induced by a data voltage. In this case, a root-mean-square (RMS) value of voltage whose value is different from the RMS value of the original voltage is applied to liquid crystal, which leads to a reduction in display quality, such as crosstalk.

The above-described problem on the pulse width modulation system still remains in the method disclosed in the above-described Japanese Laid-Open Publication No. 2-1812 where gray scale obtained by the pulse width modulation is further subjected to the frame modulation.

The above-described problems will be described in greater detail with reference to FIGS. 6 to 8 below.

For example, a display device includes a liquid crystal panel 600 with a 4 by 4 matrix of pixels as shown in FIG. 6. The liquid crystal panel 600 includes column electrodes X1 to X4 and row electrodes Y1 to Y4. Pixels P11 to P44 are defined by points of intersection of the column electrodes X1 to X4 and the row electrodes Y1 to Y4.

FIG. 7 shows, for example, patterns of gray levels of pixels in frames of the display device when all the pixels display a gray level of 5/60 using a conventional driving system. FIG. 8 shows driving waveforms XW1c to XW4c for the column electrodes X1 to X4, and driving waveforms YW1c to YW4c for the row electrodes Y1 to Y4.

Each frame displays 16-level gray scale ranging from a gray level of 0/15 to a gray level of 15/15 using the pulse width modulation system. The pattern of gray levels is rearranged for each frame in a period of 4 frames using the frame modulation system. As a result, the display device can display 61-level gray scale ranging from a gray level of 0/60 to a gray level of 60/60.

As can be seen from FIG. 7, the pixel P11 at the point of intersection of the column electrode X1 and the row electrode Y1 displays a gray level of 2/15 at the first frame and a gray level of 1/15 at the second to fourth frames, resulting in a gray level of 5/60. Each frame displays a different pattern of gray scale of pixels, but every pixel can display a gray level of 5/60 using 4 frames.

As can be seen from FIG. 8, all the driving waveforms XW1c to XW4c applied to the column electrodes X1 to X4 have higher frequency than when gray scale display is not required. This leads to an increase in the rounding of a waveform which occurs due to electrode resistance and liquid crystal capacity every time when the waveform changes. As a result, the actual waveform significantly differs from the ideal waveform that has no rounding. The driving waveforms YW1c to YW4c applied to the row electrodes Y1 to Y4 are distorted when the driving waveform applied to the column electrode changes. This is because the change induces the waveform distortion.

The higher frequency the driving waveform applied to the column electrode has, the more number of times the waveform changes, resulting in an increased rate of waveform distortion. The amplitude of the waveform distortion becomes larger as the number of column electrodes which change the waveforms thereof at the same time increases. As shown in FIG. 8, since the number of column electrodes which change the waveforms thereof at the same time is great, the amplitude of the waveform distortion is large.

Each pixel receives the addition of the driving waveform applied to the column electrode and the driving waveform applied to the row electrode. Therefore, a voltage waveform which is actually applied to each pixel includes both waveform rounding and waveform distortion. As a result, the actual waveform significantly differs from the ideal voltage waveform. Accordingly, the RMS value of a voltage becomes much different from the ideal value.

In a display device using the conventional driving system, when the number of column electrodes is, for example, several hundred, the difference between the RMS value of a voltage and the ideal value varies greatly between each column electrode. This leads to a reduction in display quality, such as crosstalk.

SUMMARY OF THE INVENTION

According to an aspect of the present invention, a control circuit for use in a display device capable of displaying gray scale including a plurality of column electrodes and a plurality of row electrodes intersecting each other and pixels provided around the intersections thereof, includes a display data converting section for receiving input display data, dividing the input display data into binary display data and gray scale display data in such a manner as to enable pulse width modulation one frame in a plurality of frames, and outputting the binary display data and the gray scale display data; a pulse controlling section for determining the timing of applying a voltage to each of the plurality of column electrodes for the gray scale display data; and a column electrode driving section for applying a voltage corresponding to the gray scale display data to at least one said column electrode based on the timing of applying a voltage determined by the pulse controlling section.

In one embodiment of the invention, the column electrode driving section includes a column electrode driver for applying the voltage to each of the plurality of column electrodes.

In one embodiment of the invention, the control circuit further includes a row electrode driving section for outputting a scanning voltage for the plurality of row electrodes.

According to another aspect of the present invention, a control circuit for use in a display device capable of displaying gray scale including a plurality of column electrodes and a plurality of row electrodes intersecting each other and pixels provided around the intersections thereof, includes a display data converting section for receiving input display data, dividing the input display data into binary display data and gray scale display data in such a manner as to enable pulse width modulation one pixel in a plurality of pixels in a row, and outputting the binary display data and the gray scale display data; a pulse controlling section for determining the timing of applying a voltage to each of the plurality of column electrodes for the gray scale display data; and a column electrode driving section for applying a voltage corresponding to the gray scale display data to at least one said column electrode based on the timing of applying a voltage determined by the pulse controlling section.

In one embodiment of the invention, the column electrode driving section includes a column electrode driver for applying the voltage to each of the plurality of column electrodes.

In one embodiment of the invention, the control circuit further includes a row electrode driving section for outputting a scanning voltage for the plurality of row electrodes.

According to still another aspect of the present invention, a control method for use in a display device capable of displaying gray scale including a plurality of column electrodes and a plurality of row electrodes intersecting each other and pixels provided around the intersections thereof, includes a display data converting step for receiving input display data, dividing the input display data into binary display data and gray scale display data, and outputting the binary display data and the gray scale display data for pulse width modulation one frame in a plurality of frames; a pulse controlling step for determining the timing of applying a voltage to each of the plurality of column electrodes for the gray scale display data; and a column electrode driving step for applying a voltage corresponding to the gray scale display data to at least one said column electrode based on the timing of applying a voltage determined by the pulse controlling step.

In one embodiment of the invention, the column electrode driving step includes a step of applying the voltage to each of the plurality of column electrodes.

In one embodiment of the invention, the control method further includes a row electrode driving step for outputting a scanning voltage for the plurality of row electrodes.

According to still another aspect of the present invention, a control method for use in a display device capable of displaying gray scale including a plurality of column electrodes and a plurality of row electrodes intersecting each other and pixels provided around the intersections thereof, includes a display data converting step for receiving input display data, dividing the input display data into binary display data and gray scale display data in such a manner as to enable pulse width modulation one pixel in a plurality of pixels in a row, and outputting the binary display data and the gray scale display data; a pulse controlling step for determining the timing of applying a voltage to each of the plurality of column electrodes for the gray scale display data; and a column electrode driving step for applying a voltage corresponding to the gray scale display data to at least one said column electrode based on the timing of applying a voltage determined by the pulse controlling step.

In one embodiment of the invention, the column electrode driving step includes a step of applying the voltage to each of the plurality of column electrodes.

In one embodiment of the invention, the control method further includes a row electrode driving step for outputting a scanning voltage for the plurality of row electrodes.

According to the present invention, the frequency of a waveform applied to each of a plurality of column electrodes is decreased. Therefore, the rounding of a data voltage can be reduced. The waveform distortion of a scanning voltage which is induced by a data voltage also occurs at a reduced rate.

Moreover, even when input display data for different column electrodes are the same, it is possible to change the waveforms of data voltages in different timings, preventing data voltages having the same waveform from being applied to different electrodes in the same horizontal scanning period. Therefore, the amplitude of waveform distortion of a scanning voltage which is induced by the data voltage can be reduced.

As a result, it is possible to obtain a driving waveform applied to the column electrode and a driving waveform applied to the row electrode, both of which are close to the respective ideal waveforms. Therefore, the RMS value of a voltage actually applied to each pixel can be close to the ideal value, thereby preventing a reduction in display quality, such as crosstalk.

Thus, the invention described herein makes possible the advantages of providing a control circuit and a control method for use in a display device in which crosstalk or the like can be reduced and thus display quality is improved in gray scale display.

These and other advantages of the present invention will become apparent to those skilled in the art upon reading and understanding the following detailed description with reference to the accompanying figures.

BRIEF DESCRIPTION OF THE DRAWINGS

FIG. 2 is a diagram showing an example of gray level patterns in the control circuit and the control method of the display device of Example 1.

FIG. 4C is a diagram showing an example of gray level patterns in the control circuit and the control method of the display device of Example 2.

FIG. 7 is a diagram showing an example of gray level patterns in a conventional control method for a display device.

DESCRIPTION OF THE PREFERRED EMBODIMENTS

Examples of the present invention will be described below in great detail with reference to the accompanying drawings.

(Example 1)

Figure 1A:
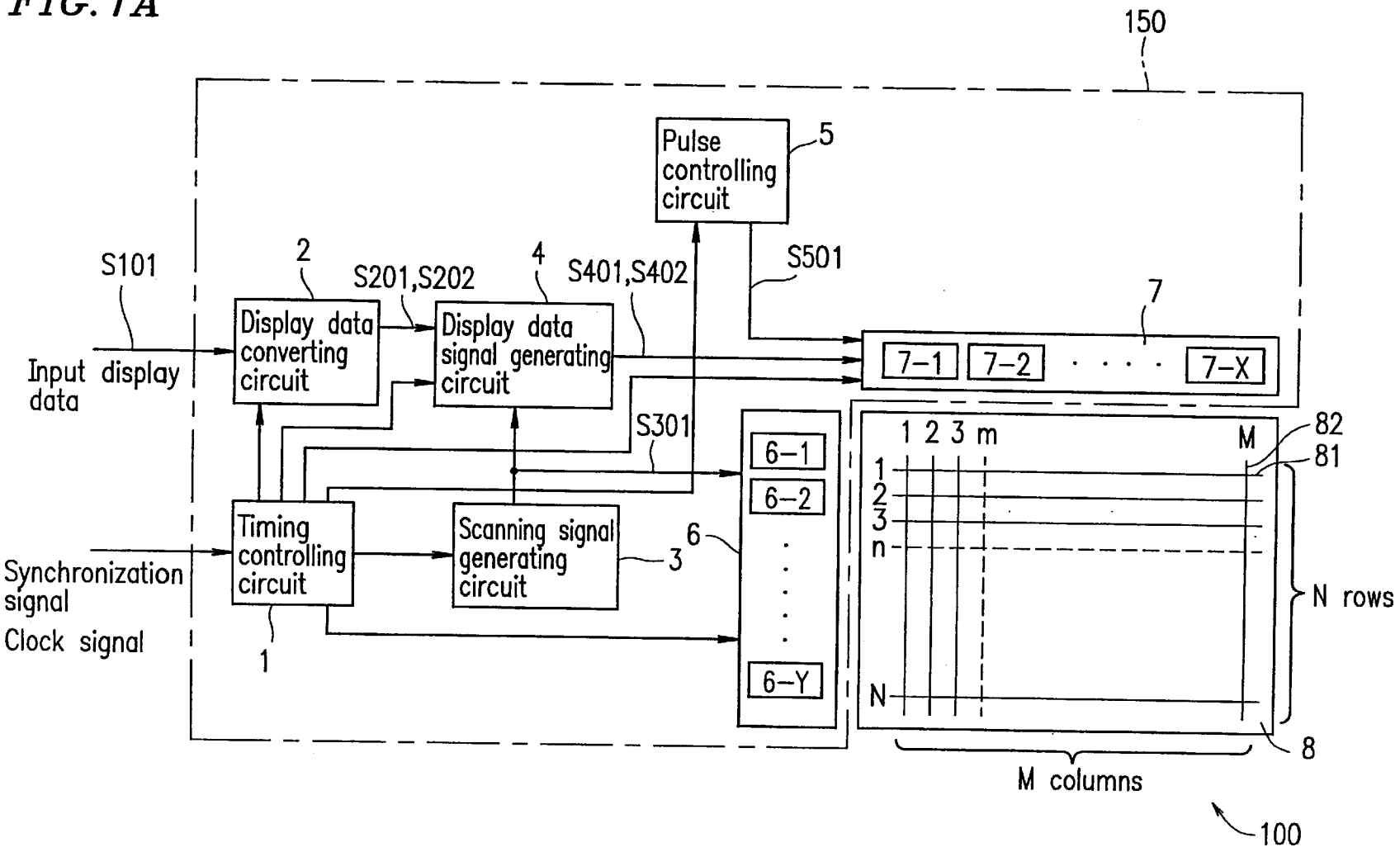
FIG. 1A is a block diagram showing an example configuration of a control circuit of a display device according to Example 1 of the present invention.
Figure 1B:
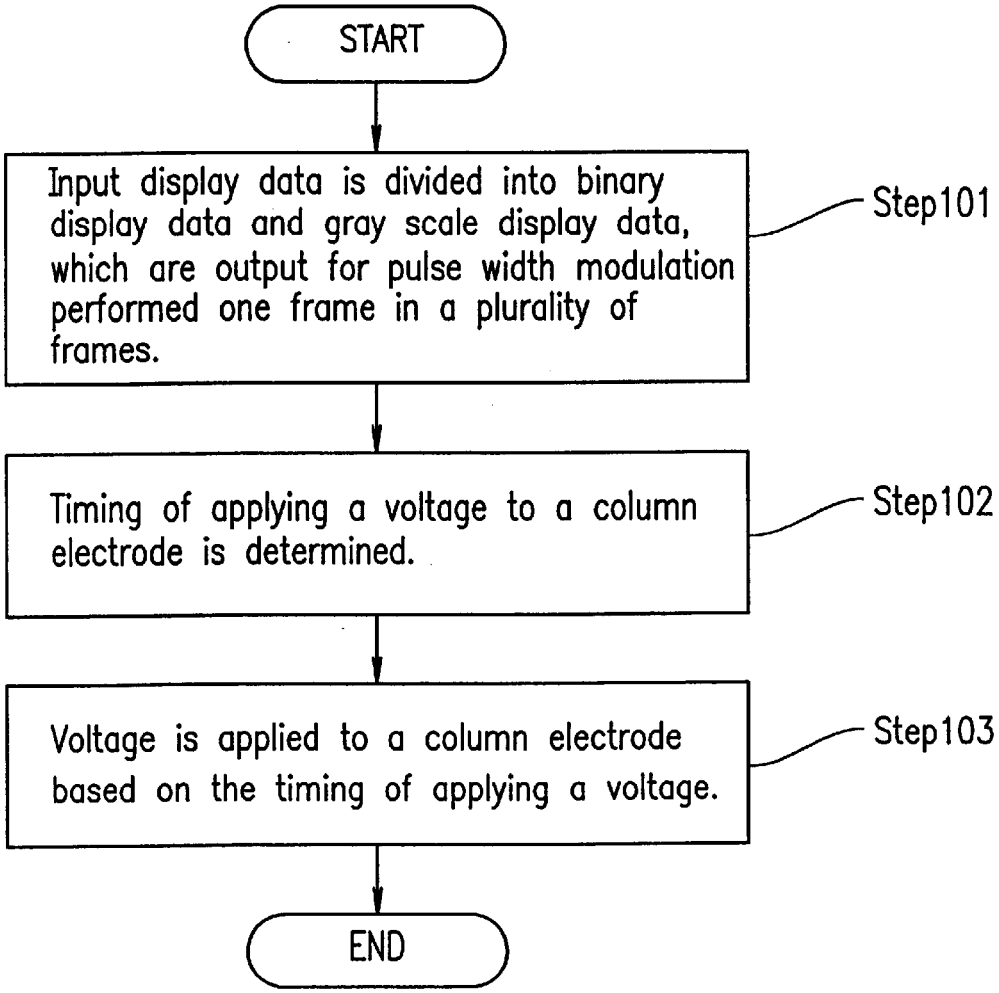
FIG. 1B is a flowchart illustrating the operation of the display-device of Example 1.

FIG. 1A shows an example configuration of a display device 100 according to Example 1 of the present invention. FIG. 1B is a flowchart illustrating the operation of the display device 100.

As shown in FIG. 1A, the display device 100 of Example 1 includes a control circuit 150. The control circuit 150 includes a timing controlling circuit 1, a display data converting circuit 2, a scanning signal generating circuit 3, a display data signal generating circuit 4, a pulse controlling circuit 5, a row electrode driving circuit 6, and a column electrode driving circuit 7. The control circuit 150 controls the display of a display panel 8.

The timing controlling circuit 1 controls the timing of the whole system of the display device 100.

The display data converting circuit 2 receives input display data S101 containing a plurality of bits, and divides the input display data S101 into binary display data S201 and gray scale display data S202 in such a manner as to enable pulse width modulation one frame in a plurality of frames. The display data converting circuit 2 switches between the binary display data S201 and the gray scale display data S202 for each frame and outputs either of them to the display data signal generating circuit 4 (step 101).

Here, the binary display data is represented by one bit which determines a pixel to be either of two display states, i.e., ON-display or OFF-display. For example, when the binary display data is "1", a pixel is in the ON-display state, while when the binary display data is "0", a pixel is in the OFF-display state. The gray scale display data is represented by multiple bits which determine a pixel to be in a gray scale display state which is an.. intermediate state between ON-display and OFF-display. For example, in the case of 16-level gray scale, the gray scale display data is represented by 4 bits, including 0000, 0001, 0010, . . . , 1101, 1110, 1111 which correspond to OFF-display, $1/15$ gray level display, $2/15$ gray level display, . . . , $13/15$ gray level display, $14/15$ gray level display, ON-display.

The scanning signal generating circuit 3 generates a scanning signal S301 in accordance with the number of column electrodes and a scanning order which are defined by a progressive driving system or a multiple line simultaneous driving system. The scanning signal generating circuit 3 outputs the scanning signal S301 to the display data signal generating circuit 4 and the row electrode driving circuit 6 at the time when the binary display data S201 or the gray scale display data S202 is input to the display data signal generating circuit 4.

The display data signal generating circuit 4 receives the binary display data S201 or the gray scale display data S202, and the scanning signal S301. When receiving the binary display data S201, the display data signal generating circuit 4 generates a display data signal S401 which determines a pixel to be in the ON- or OFF-display state. When receiving the gray scale display data S202, the display data signal generating circuit 4 generates a display data signal S402 containing a weighted pulse for each pixel. The display data signal generating circuit 4 outputs the display data signal S401 or S402 to the column electrode driving circuit 7.

The pulse controlling circuit 5 divides one horizontal scanning period into a plurality of intervals, and generates a gray scale control clock S501 for the voltage of the display data signal S401 or S402 applied to column electrodes 82. The pulse controlling circuit 5 outputs the gray scale control clock S501 to the column electrode driving circuit 7 (step 102).

The row electrode driving circuit 6 includes a plurality of row electrode drivers 6-1, 6-2, . . . , 6-Y depending on the number N of row electrodes 81 provided in the display panel 8. The row electrode driving circuit 6 outputs scanning voltages sequentially to the row electrodes 81 based on the scanning signal S301 output from the scanning signal generating circuit 3.

The column electrode driving circuit 7 includes a plurality of column electrode drivers 7-1, 7-2, . . . 7-X depending on the number M of column electrodes 82 provided in the display panel 8. The column electrode driving circuit 7 applies data voltages based on the display data signal S401 or S402 output from the display data signal generating circuit 4 and the gray scale control clock S501 output from the pulse controlling circuit 5 to M column electrodes 82 at the same time (step 103).

The display panel 8 includes N row electrodes 81 and M column electrodes 82. N row electrodes 81 and M column electrodes 82 intersect each other, so that the intersections are arranged in a matrix pattern. The row electrode 81 and the column electrode 82 sandwich a display medium such as liquid crystal and each intersection corresponds to a pixel. The display medium at each pixel responds to a driving voltage applied between the row electrode 81 and the column electrode 82, and changes its optical state according to the RMS value of the driving voltage. As a result, the display panel 8 displays an image corresponding to the input display data S101.

A method for driving a display panel shown in FIG. 6 with a 4 by 4 matrix of pixels using the control circuit of the display device according to Example 1 will be described in detail.

FIG. 2 shows an example of patterns of gray levels of pixels in frames when the display panel is driven by the control circuit 150 of Example 1. Here, all the pixels display a $5/60$ gray level. Specifically, as shown in FIG. 2, the pixel P11 at the point of intersection of the column electrode X1 and the row electrode Y1 displays a gray level of $5/15$ at the first frame and OFF-display at the second to fourth frames, resulting in a gray level of 5/60. In the similar manner, the other pixels each can display a gray level of 5/60 using 4 frames.

Figure 3:
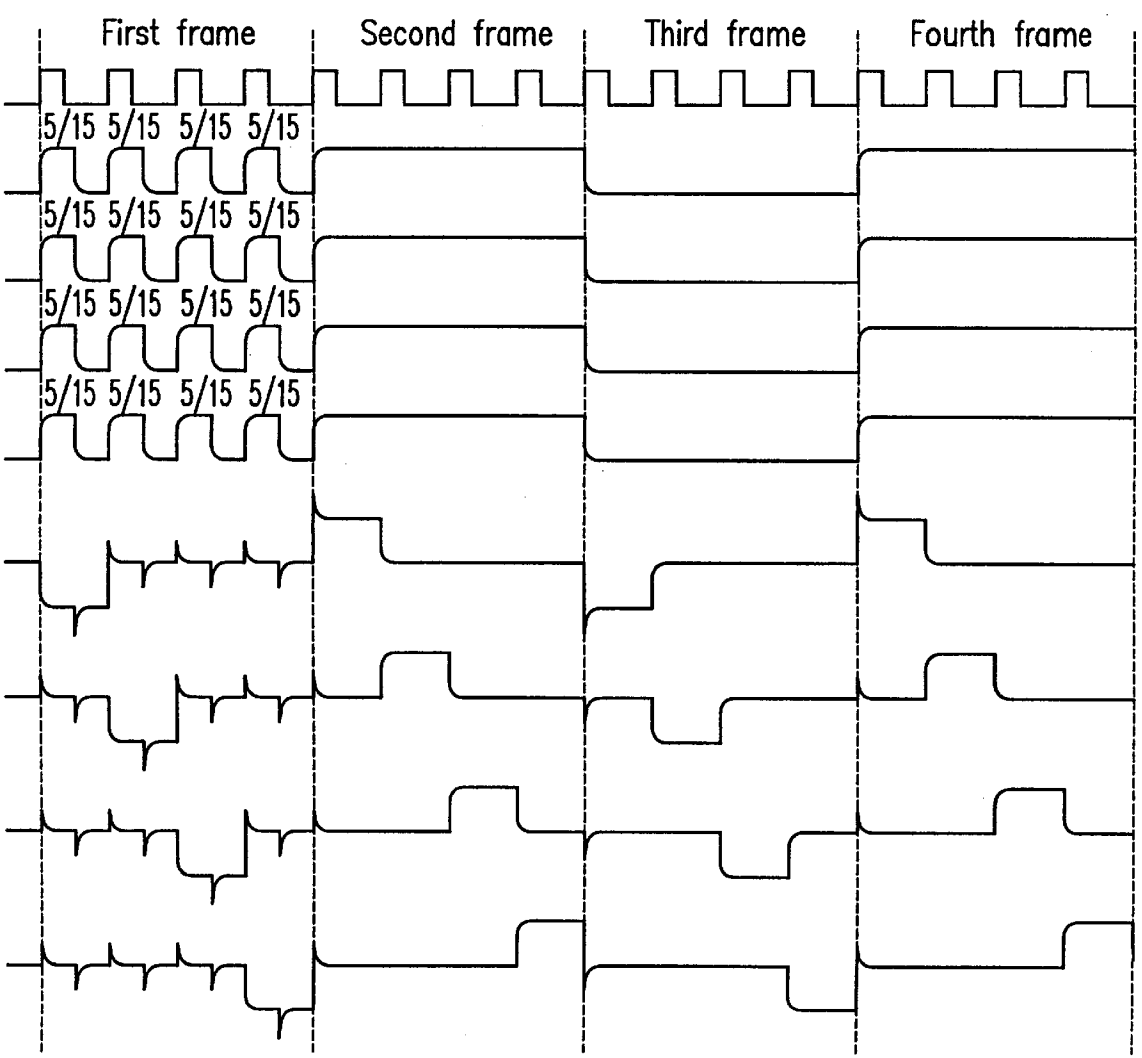
FIG. 3 is a diagram showing an example of driving waveforms in the control circuit and the control method of the display device of Example 1.
Figure 8:
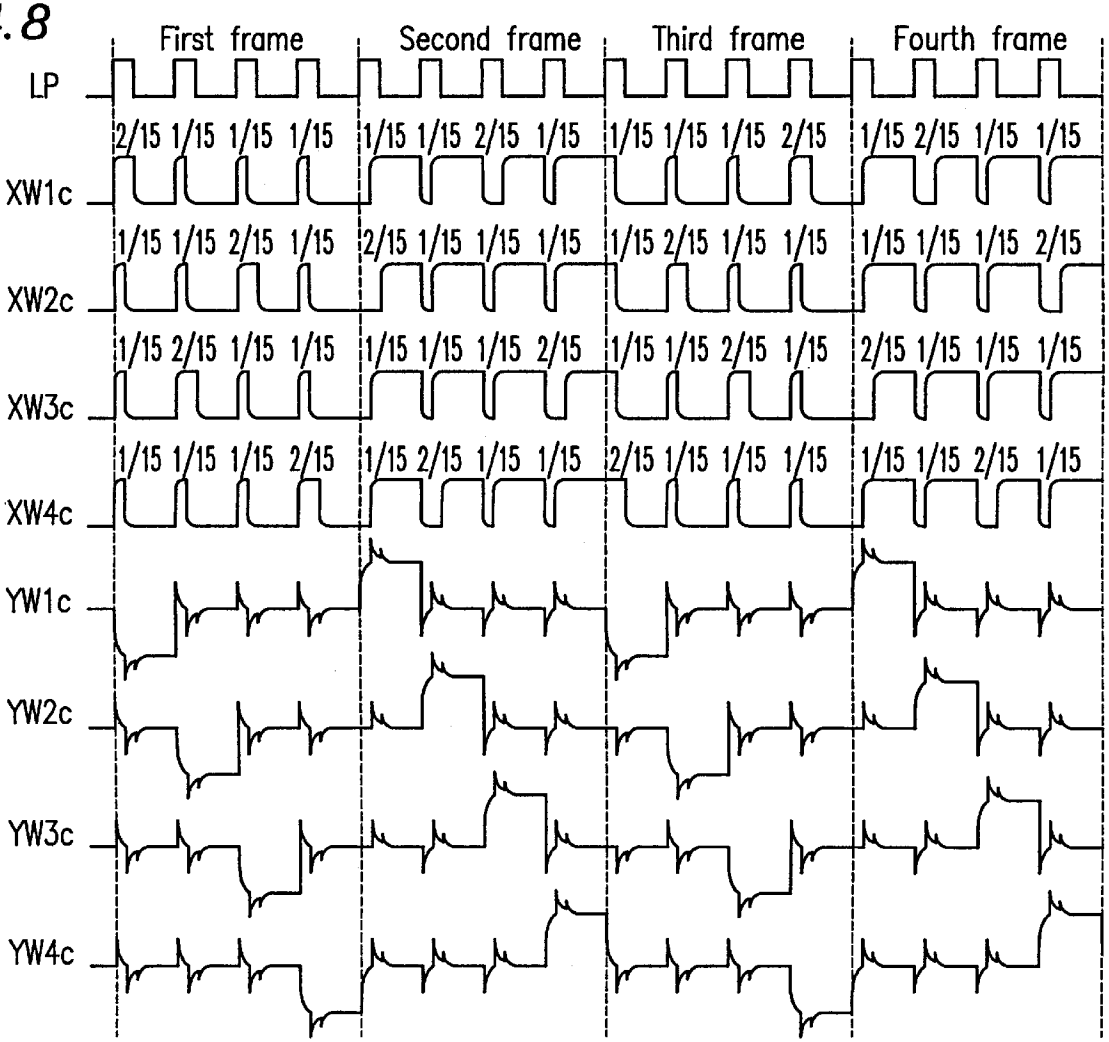
FIG. 8 is a diagram showing an example of driving waveforms in a conventional control method for a display device.

FIG. 3 shows an example set of driving waveforms XW1b to XW4b for the column electrodes X1 to X4, and driving waveforms YW1b to YW4b for the row electrodes Y1 to Y4 to achieve the display shown in FIG. 2. As can be seen from FIG. 3, the frequency of a waveform applied to each of the column electrodes X1 to X4 becomes lower than when using the conventional method shown in FIG. 8. This is because there is no change in the waveform in the second to fourth frames in the OFF-display state. Thus, the rounding of the waveform of a data voltage can be reduced and also the rate at which the waveform distortion of a scanning voltage induced by the data voltage can be decreased.

As a result, both a driving waveform applied to the column electrode and a driving waveform applied to the row electrode are close to the ideal driving waveforms, whereby the RMS value of a voltage actually applied to each pixel is close to the ideal value. Thus, disadvantages such as crosstalk can be eliminated.

(Example 2)

Figure 4A:
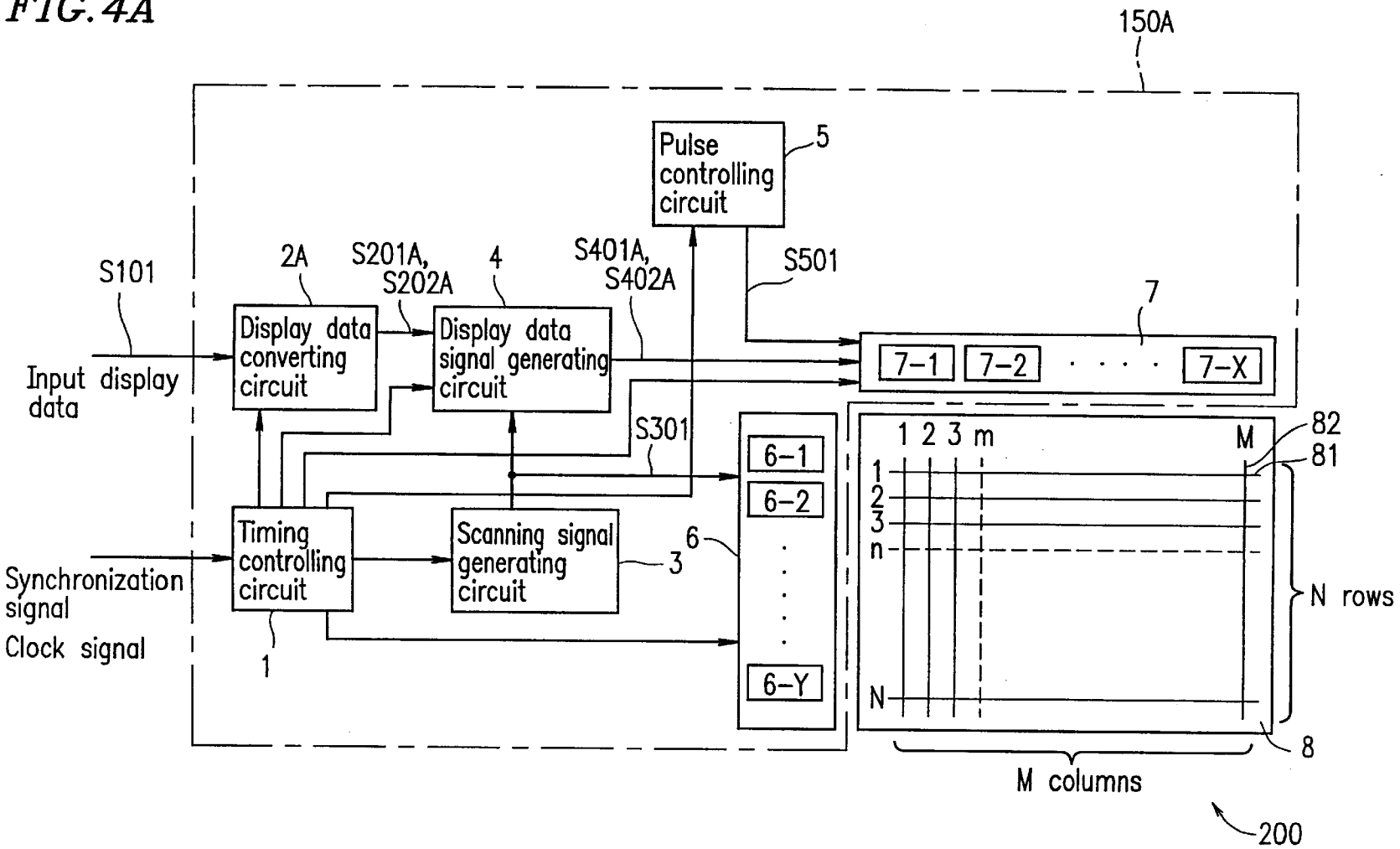
FIG. 4A is a block diagram showing an example configuration of a control circuit of a display device according to Example 2 of the present invention.
Figure 4B:
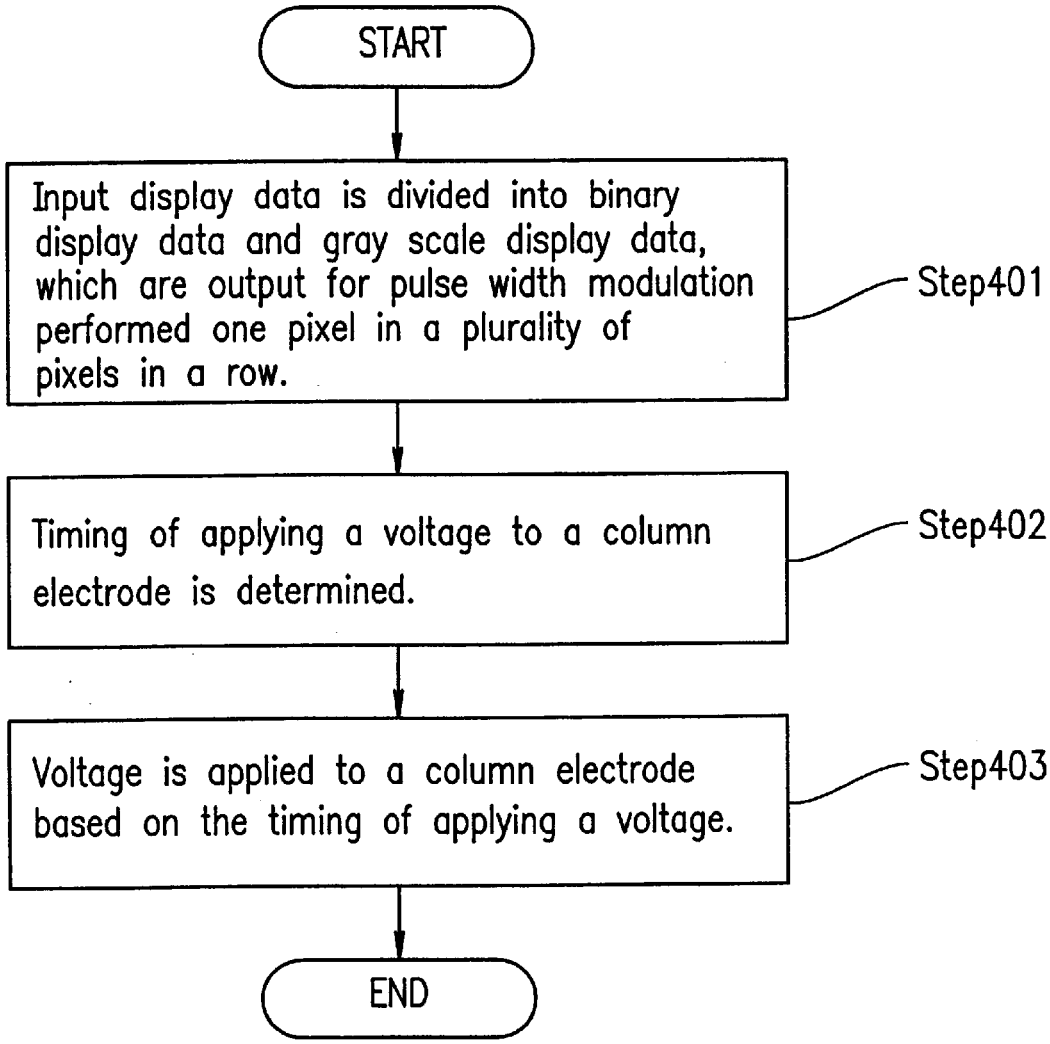
FIG. 4B is a flowchart illustrating the operation of the display device of Example 2.

FIG. 4A shows an example configuration of a display device 200 according to Example 2 of the present invention. FIG. 4B is a flowchart illustrating the operation of the display device 200.

A control circuit 150A of the display device 200 of Example 2 includes a display data converting circuit 2A which performs pulse width modulation one pixel in a plurality of adjacent pixels in a row instead of the display data converting circuit 2 of the control circuit 150 as shown in FIG. 1.

The display data converting circuit 2A receives input display data S101 containing a plurality of bits, and divides the input display data S101 into binary display data S201 and gray scale display data S202 in such a manner as to enable pulse width modulation one pixel in a plurality of adjacent pixels in a row. The display data converting circuit 2A switches between the binary display data S201A and the gray scale display data S202A for each frame and outputs either of them to the display data signal generating circuit 4 (step 401).

The scanning signal generating circuit 3 generates a scanning signal S301 in accordance with the number of column electrodes and a scanning order which are defined by a progressive driving system or a multiple line simultaneous driving system. The scanning signal generating circuit 3 outputs the scanning signal S301 to the display data signal generating circuit 4 and the column electrode driving circuit 6 at the time when the binary display data S201A or the gray scale display data S202A is input to the display data signal generating circuit 4.

The display data signal generating circuit 4 receives the binary display data S201A or the gray scale display data S202A, and the scanning signal S301. When receiving the binary display data S201A, the display data signal generating circuit 4 generates a display data signal S401A which determines a pixel to be in the ON- or OFF-display state. When receiving the gray scale display data S202A, the display data signal generating circuit 4 generates a display data signal S402A containing a weighted pulse for each pixel. The display data signal generating circuit 4 outputs the display data signal S401A or S402A to the column electrode driving circuit 7.

The pulse controlling circuit 5 divides one horizontal scanning period into a plurality of intervals, and generates a gray scale control clock S501 for the voltage of the display data signal S401A or S402A applied to column electrodes 82. The pulse controlling circuit 5 outputs the gray scale control clock S501 to the column electrode driving circuit 7 (step 402).

The column electrode driving circuit 7 includes a plurality of column electrode drivers 7-1, 7-2, . . . , 7-X depending on the number M of column electrodes 82 provided in the display panel 8. The column electrode driving circuit 7 applies data voltages based on the display data signal S401A or S402A output from the display data signal generating circuit 4 and the gray scale control clock S501 output from the pulse controlling circuit 5 to M column electrodes 82 at the same time (step 403).

A method for driving a display panel shown in FIG. 6 with a 4 by 4 matrix of pixels using the control circuit 150A of the display device 200 according to Example 2 will be described below in detail.

FIG. 4C shows an example of patterns of gray levels of pixels in frames when the display panel is driven by the control circuit 150A of Example 2. Here, the pulse width modulation is performed one pixel in a plurality of adjacent pixels in a row, and all the pixels display a 5/60 gray level. At the first frame, of adjacent pixels P11, P12, P13, P14, the pulse width modulation is performed only for the pixel P11; of adjacent pixels P21, P22, P23, P24, the pulse width modulation is performed only for the pixel P23; of adjacent pixels P31, P32, P33, P34, the pulse width modulation is performed only for the pixel P32; and of adjacent pixels P41, P42, P43, P44, the pulse width modulation is performed only for the pixel P44. In the similar manner, the pulse width modulation is performed one pixel in a plurality of pixels in a row at the second to fourth frames.

Specifically, as shown in FIG. 4C, the pixel P11 at the point of intersection of the column electrode X1 and the row electrode Y1 displays a gray level of 5/15 at the first frame and OFF-display at the second to fourth frames, resulting in a gray level of 5/60. The pixel P12 at the point of intersection of the column electrode X2 and the row electrode Y1 displays a gray level of 5/15 at the second frame and OFF-display at the first, third and fourth frames. Although a different pattern of a gray level at each frame is used, any other pixel can display a gray level of 5/60 using 4 frames.

Figure 5:
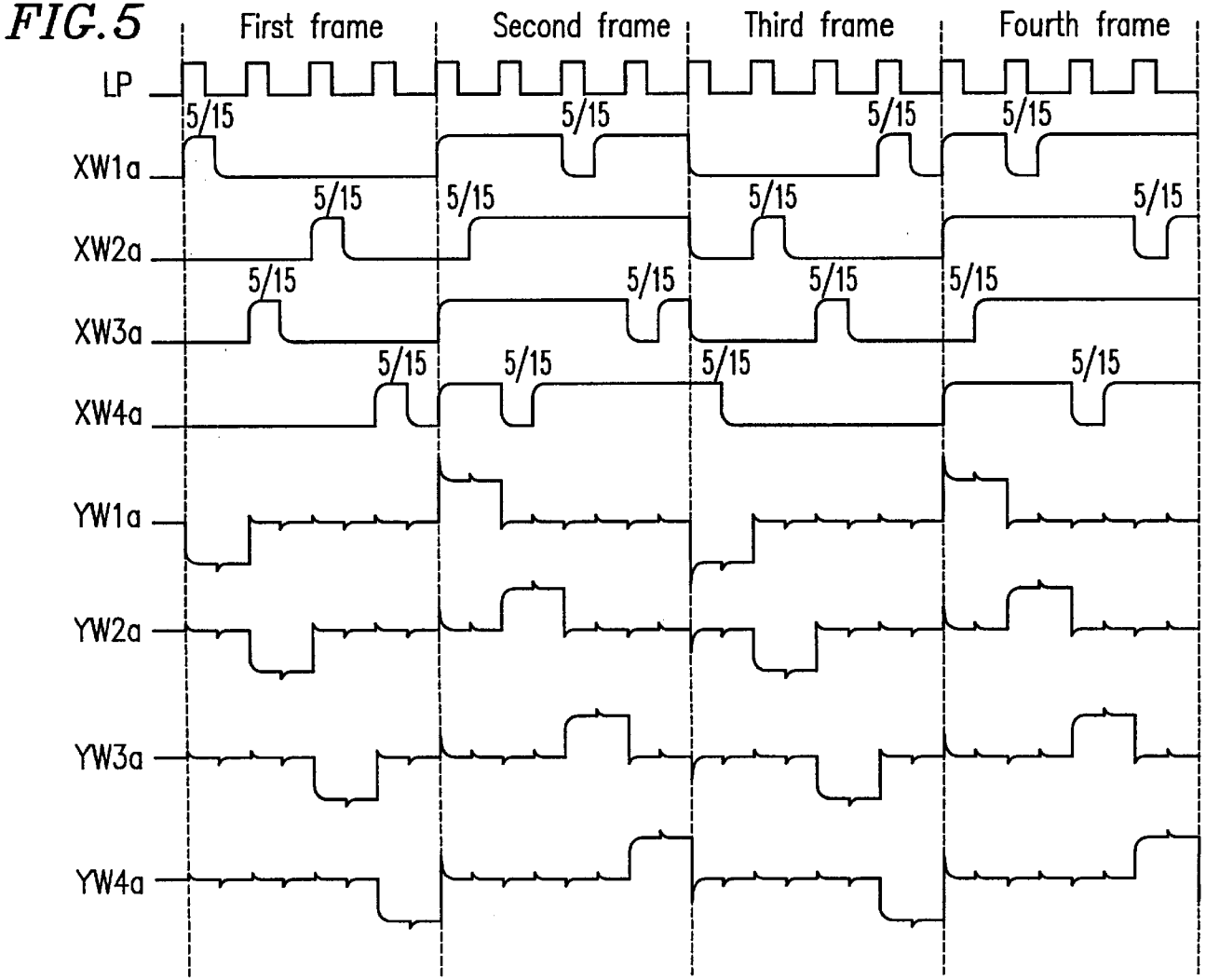
FIG. 5 is a diagram showing an example of driving waveforms in the control circuit and the control method of the display device of Example 2.

FIG. 5 shows an example set of driving waveforms XW1*a* to XW4*a* for the column electrodes X1 to X4, and driving waveforms YW1*a* to YW4*a* for the row electrodes Y1 to Y4 which achieve the display shown in FIG. 4C. As can be seen from FIG. 5, the frequency of a waveform applied to each of the electrodes X1 to X4 becomes lower than when using the conventional method shown in FIG. 8. Even when input display data for different column electrodes are the same, it is possible to change the waveforms of data voltages in different timings, preventing the same waveforms of data voltages from being applied to different electrodes in the same horizontal scanning period.

The pulse width modulation is performed one frame in a plurality of frames, thereby reducing the frequency of a waveform applied to each of a plurality of column electrodes. In addition, the pulse width modulation is performed one pixel in a plurality of adjacent pixels in a row, whereby even when input display data for different column electrodes are the same, it is possible to change the waveforms of data voltages in different timings, preventing the same waveforms of data voltages from being applied to different electrodes in the same horizontal scanning period.

Therefore, the rate at which the waveform distortion of a scanning voltage induced by the data voltage can be decreased. In addition, the amplitude of the waveform distortion of a scanning voltage can be reduced, since the number of column electrodes which change the waveform thereof at the same time becomes less than when using the conventional method shown in FIG. 8.

As a result, both a driving waveform applied to the column electrode and a driving waveform applied to the row electrode are close to the ideal driving waveform, whereby the RMS value of a voltage actually applied to each pixel is close to the ideal value. Thus, a reduction in display quality, such as crosstalk, can be prevented.

An experiment was actually conducted where a color liquid crystal panel was constructed as the above-described display device 100. The liquid crystal panel has 300 row electrodes (N=300) and 2400 column electrodes (M=2400=800×RGB), a threshold voltage of 2.3 V, and a response speed ($\tau r+\tau d$) of 150 ms. The color liquid crystal panel was driven by either of a 2-line simultaneous selection driving system and a progressive driving system.

As a result, the crosstalk which had been so far caused by the induced distortion was largely reduced, thereby obtaining 260,000-color display, each color being represented by 6 bits. Further, 16.77 million-color display, each color being represented by 8 bits, could be obtained in combination with a 2-bit dithering.

Figure 6:
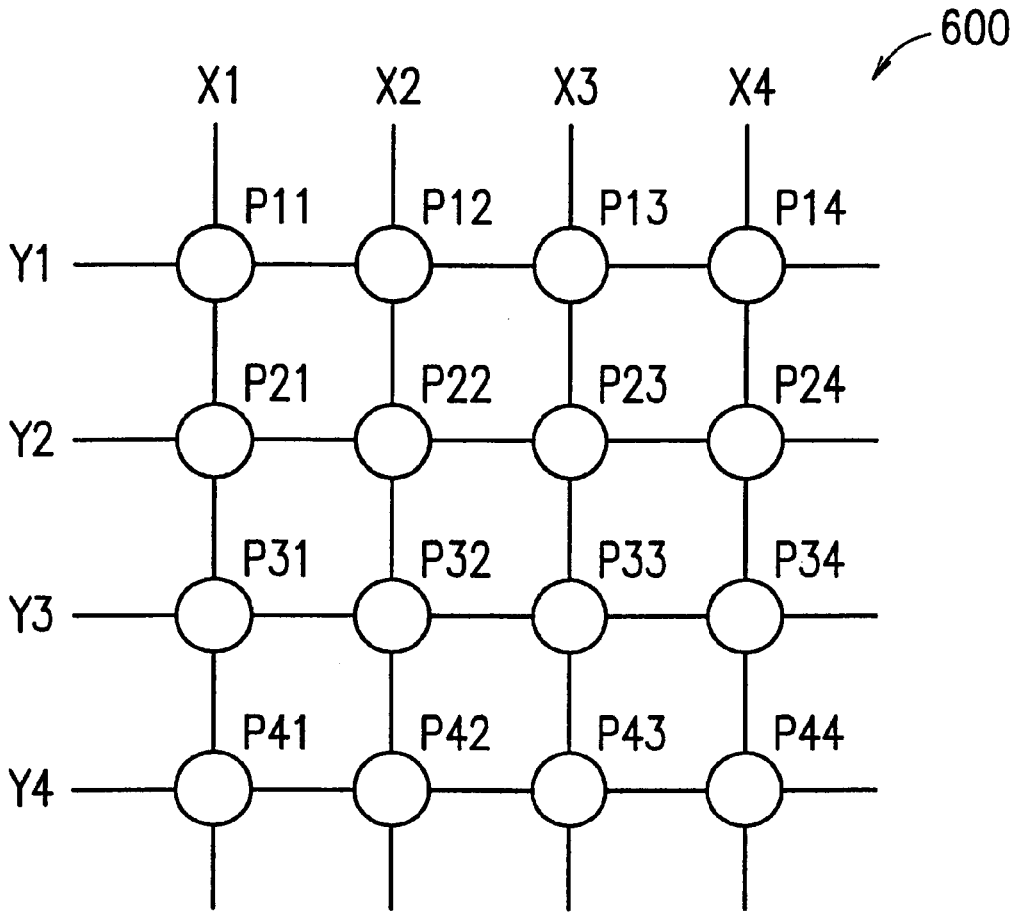
FIG. 6 is a diagram showing a liquid crystal panel with 4 rows and 4 columns as an example of a display device.

In the above-described Examples, for the sake of simplicity, the control circuit and the control method of the display device according the present invention is explained using the display panel with a 4 by 4 matrix of pixels shown in FIG. 6. This invention is not limited to those Examples. Needless to say, the same effects can be obtained when a screen includes N columns and M rows.

As described above, according to the present invention, the frequency of a waveform applied to each of a plurality of column electrodes can be decreased. Therefore, the rounding of a data voltage can be reduced. The waveform distortion of a scanning voltage which is induced by a data voltage also occurs at a reduced rate.

Moreover, pulse width modulation may be performed one pixel in a plurality of adjacent pixels in a row by a display data converting means. In this case, even when input display data for different column electrodes are the same, it is possible to change the waveforms of data voltages in different timings, preventing the same waveforms of data voltages from being applied to different electrodes in the same horizontal scanning period. Therefore, the amplitude of waveform distortion of a scanning voltage which is induced by the data voltage can be reduced.

As a result, it is possible to obtain a driving waveform applied to the column electrode and a driving waveform applied to the row electrode, both of which are close to the respective ideal waveforms. Therefore, the RMS value of a voltage actually applied to each pixel can be close to the ideal value, thereby preventing a reduction in display quality, such as crosstalk.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A control circuit for use in a display device capable of displaying gray scale including a plurality of column electrodes and a plurality of row electrodes intersecting each other and pixels provided around the intersections thereof, the control circuit comprising:

a display data converting section for receiving input display data, dividing the input display data into binary display data and gray scale display data in such a manner as to enable pulse width modulation only one frame in a plurality of frames, and outputting the binary display data and the gray scale display data;

a pulse controlling section for determining the timing of applying a voltage to each of the plurality of column electrodes for the gray scale display data; and, a column electrode driving section for applying a voltage corresponding to the gray scale display data to at least one said column electrode based on the timing of applying a voltage determined by the pulse controlling section.

2. A control circuit according to claim 1, wherein the column electrode driving section includes a column electrode driver for applying the voltage to each of the plurality of column electrodes.

3. A control circuit according to claim 1 further comprising a row electrode driving section for outputting a scanning voltage for the plurality of row electrodes.

4. A control method for use in a display device capable of displaying gray scale including a plurality of column electrodes and a plurality of row electrodes intersecting each other and pixels provided around the intersections thereof, the control method comprising:

a display data converting step for receiving input display data, dividing the input display data into binary display data and gray scale display data, and outputting the binary display data and the gray scale display data for pulse width modulation only one frame in a plurality of frames;

a pulse controlling step for determining the timing of applying a voltage to each of the plurality of column electrodes for the gray scale display data; and a column electrode driving step for applying a voltage corresponding to the gray scale display data to at least one said column electrode based on the timing of applying a voltage determined by the pulse controlling step.

5. A control method according to claim 4, wherein the column electrode driving step includes a step of applying the voltage to each of the plurality of column electrodes.

6. A control method according to claim 4 further comprising a row electrode driving step for outputting a scanning voltage for the plurality of row electrodes.

7. A control circuit for use in a display device capable of displaying gray scale including a plurality of column electrodes and a plurality of row electrodes intersecting each other and pixels provided around the intersections thereof, the control circuit comprising:

a display data converting section for receiving input display data, dividing the input display data into binary display data and gray scale display data in such a manner as to enable pulse width modulation only one frame in a plurality of frames and one pixel in a plurality of pixels in a row of said one frame, and for outputting the binary display data and the gray scale display data;

a pulse controlling section for determining the timing of applying a voltage to each of the plurality of column electrodes for the gray scale display data; and a column electrode driving section for applying a voltage corresponding to the gray scale display data to at least one said column electrode based on the timing of applying a voltage determined by the pulse controlling section.

8. A control circuit according to claim 7 wherein the column electrode driving section includes a column electrode driver for applying the voltage to each of the plurality of column electrodes.

9. A control circuit according to claim 7 further comprising a row electrode driving section for outputting a scanning voltage for the plurality of row electrodes.

10. A control method for use in a display device capable of displaying gray scale including a plurality of column electrodes and a plurality of row electrodes intersecting each other and pixels provided around the intersections thereof, the control method comprising:

a display data converting step for receiving input display data, dividing the input display data into binary display data and gray scale display data, and outputting the binary display data and the gray scale display data for pulse width modulation only one frame in a plurality of frames and one pixel in a plurality of pixels in a row of said one frame;

a pulse controlling step for determining the timing of applying a voltage to each of the plurality of column electrodes for the gray scale display data; and a column electrode driving step for applying a voltage corresponding to the gray scale display data to at least one said column electrode based on the timing of applying a voltage determined by the pulse controlling step.

11. A control method according to claim 10, wherein the column electrode driving step includes a step of applying the voltage to each of the plurality of column electrodes.

12. A control method according to claim 10, further comprising a row electrode driving step for outputting a scanning voltage for the plurality of row electrodes.

* * * * *